US006227930B1

(12) United States Patent
Norman et al.

(10) Patent No.: US 6,227,930 B1
(45) **Date of Patent: *May 8, 2001**

(54) DOLL'S CLOTHING

(76) Inventors: Casey William Norman, 97 Earls Court Road, London W8 6QH (GB); Torquil Patrick Alexander Norman, 62 Gloucester Crescent, London NW1 7EG. (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/065,119

(22) Filed: Apr. 23, 1998

(30) Foreign Application Priority Data

Jul. 24, 1997 (GB) ..... 9715596
Jan. 15, 1998 (GB) ..... 9800856

(51) Int. Cl.[7] ..... A63H 3/52
(52) U.S. Cl. ..... 446/268; 446/376; 2/243.1
(58) Field of Search ..... 446/6, 26, 28, 446/268, 385, 376, 491; 2/243.1

(56) References Cited

U.S. PATENT DOCUMENTS 2,283,238 * 5/1942 Thompson .
2,359,948 * 10/1944 Tillotson .
2,942,271 6/1960 Frankenfield ..... 2/74
2,944,368 7/1960 O'Brian .
3,206,533 * 9/1965 Serra .
3,783,554 1/1974 Shapero .
4,227,340 10/1980 Goldfarb et al. .
4,297,153 * 10/1981 Erickson et al. ..... 446/268
4,414,774 11/1983 Fogarty et al. .
4,763,940 * 8/1988 Held .
5,186,673 2/1993 Fogarty et al. ..... 446/98
5,194,034 * 3/1993 Heppenstall ..... 446/369
5,586,340 * 12/1996 Russo ..... 2/67

FOREIGN PATENT DOCUMENTS 835088 9/1958 (GB) .
1294637 11/1972 (GB) .
1518830 7/1978 (GB) .

* cited by examiner

*Primary Examiner*—Jacob K. Ackun
*Assistant Examiner*—Jeffrey D. Carlson

(57) ABSTRACT

Doll's garments made from an elastomeric material or rubber. The garments are particularly useful with articulated dolls and can be fitted to or removed from dolls in a life-like manner.

11 Claims, 3 Drawing Sheets

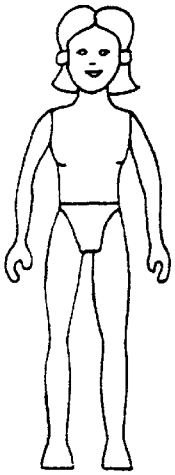
Fig. 2a
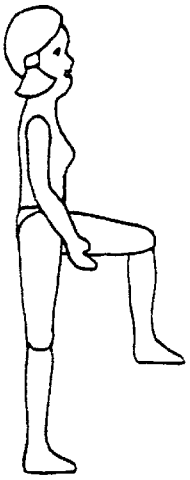
Fig. 2b
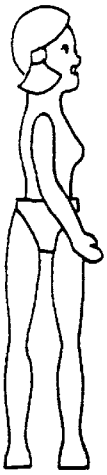
Fig. 2c
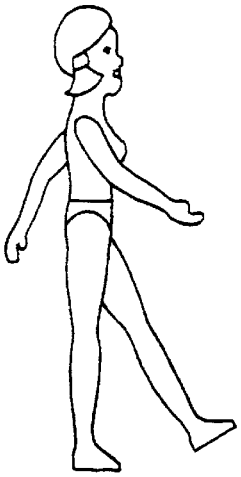
Fig. 2d
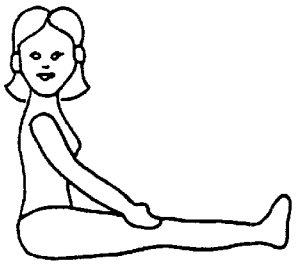
Fig. 2e
Fig. 2f
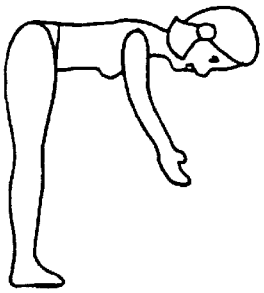

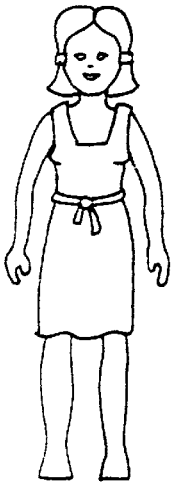
Fig. 3a
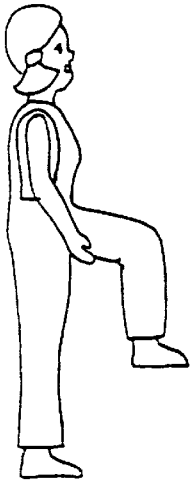
Fig. 3b
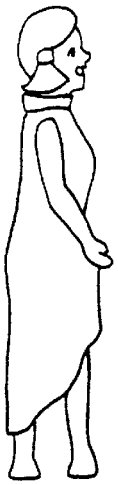
Fig. 3c
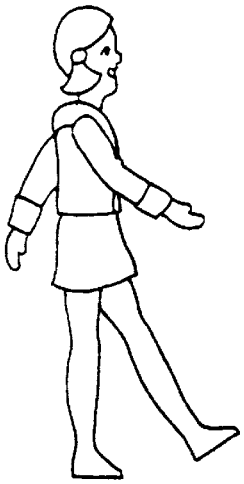
Fig. 3d
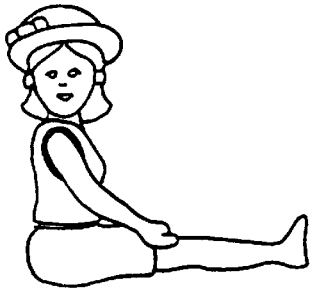
Fig. 3e
Fig. 3f
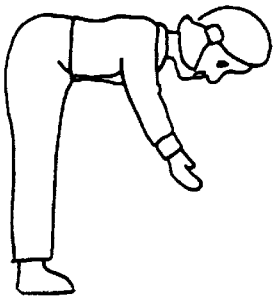

DOLL'S CLOTHING

BACKGROUND TO THE INVENTION

The present invention relates to a doll's garment, a method for the manufacture thereof and to a set comprising a doll and at least one garment therefor.

Traditionally, doll's clothes are stitched from fabric, but this is impracticable for making clothes for dolls smaller than about 8 cm in height, due to the difficulty experienced in forming the stitches.

Various proposals have therefore been advanced for making articles simulating doll's clothing from alternative materials. For example, U.S. Pat. No. 4,414,774 describes fabricating such articles from plastics materials. The articles are said to be "semi-rigid or flexible" but in practice their degree of rigidity is such that they lack realism and appear bulky, cannot be fitted or removed in a life-like manner and are restricted to dolls of a particular shape. In addition, once the doll is clothed, its limbs cannot be moved so that the articles are unsuitable for dolls with articulated limbs.

SUMMARY OF THE INVENTION

In order to overcome at least some of these disadvantages, from a first aspect, the present invention provides a removable doll's garment made from an elastomeric material or rubber.

The material may in particular be selected from ethylene vinyl acetate copolymer (EVA) and any of the polymers sold under the registered trade mark "Kraton" by Shell Chemical Co (such as (optionally hydrogenated) styrene-butadiene-styrene, styrene-isoprene-styrene, styrene-diene, styrene-isoprene and styrene-butadiene block copolymers, styrene-ethylene-butylene block copolymer containing mineral oil, branched styrene copolymer, styrene-butadiene rubber, styrene-butadiene triblock rubber, styrene-isoprene-styrene linear block polymer, styrene-butadiene radial block copolymer, butadiene-styrene copolymer rubber, or synthetic rubber). Preferably, the average modulus of elasticity of the material is less than 1 $MNm^{-2}$. More preferably, the 100% modulus of elasticity, measured at a standard test speed of 500 mm/min, is between 120 and 350 $kNm^{-2}$, and still more preferably between 240 and 280 $kNm^{-2}$. The 300% modulus of elasticity may lie between 440 and 490 $kNm^{-2}$. Such values provide a material from which garments with sufficient realism can be molded, whilst avoiding increased difficulty in molding detail and in removal of the molded garments from the mold which the inventors have found to occur with highly elastic polymers.

Advantageously, the wall thickness of the garment is from 1 to 3 mm.

From a second aspect, the present invention provides a method of manufacturing a doll's garment, comprising molding an elastomeric material or rubber. Preferably, the garment is injection molded, but it may alternatively be dip molded. The material may in particular be selected from those listed above.

From a third aspect, the invention provides a play set comprising a doll having articulated limbs and at least one garment for the doll, the or each garment being made from an elastomeric material or rubber.

The doll is preferably articulated at the shoulders and hips and may additionally be articulated at the elbows and/or the knees. The doll may be less than 8 cm in height and in a particular embodiment, the doll is approximately 4 cm in height.

BRIEF DESCRIPTION OF THE DRAWINGS

The invention will now be described, by way of example only, with reference to the accompanying drawings, in which:

FIGS. 2*a* to 2*f* show a doll according to an embodiment of the invention in various different positions; and FIGS. 3*a* to 3*f* show the doll of FIGS. 2*a* to 2*f* dressed in the garments of FIGS. 1*a* to 1*f* respectively.

DETAILED DESCRIPTION OF THE PREFERRED EMBODIMENTS

Figure 1A:
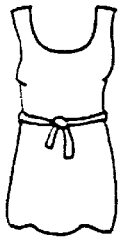
FIGS. 1*a* to 1*g* show doll's garments according to embodiments of the invention.
Figure 1B:
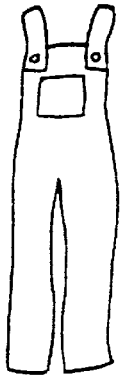
Figure 1C:
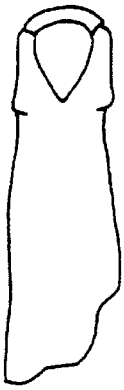
Figure 1G:
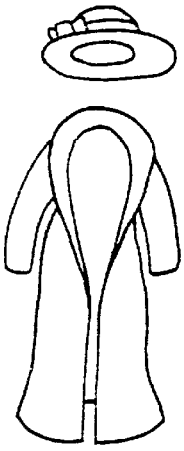
Figure 1D:
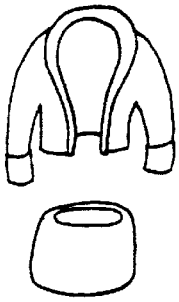
Figure 1E:
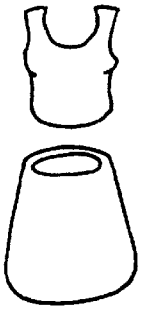
Figure 1F:
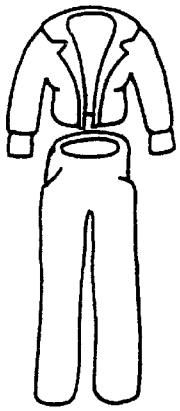

FIGS. 1*a* to 1*g* show various injection-molded (i.e., seamlessly integral) garments for a doll approximately 4 cm in height. More specifically, FIG. 1*a* shows a dress, FIG. 1*b* a pair of dungarees, FIG. 1*c* a gown, FIG. 1*d* a jacket and skirt, FIG. 1*e* a vest and skirt, FIG. 1*f* a jacket and a pair of slacks and FIG. 1*g* a hat and coat. The garments are molded from elastomeric materials or rubber and are therefore noticeably flexible and elastic, which provides a high degree of realism as compared with prior art garment-simulating articles. The realism is further enhanced by decorating the garment using paint, varnish, glitter etc.

Additionally details such as belts, buttons, and collars are provided by the molding process. In a particular example, the garments are molded from clear Kraton and painted with a paint of which the modulus of elasticity is compatible with that of the Kraton.

FIGS. 2*a* to 2*f* show a three-dimensional doll which is approximately 4 cm in height. The doll is assembled from injection-molded plastics components and is articulated at the shoulders, hips and knees.

FIGS. 3*a* to 3*f* show the doll of FIGS. 2*a* to 2*f* after fitting of the garments shown in FIGS. 1*a* to 1*f* respectively. Due to their elasticity, the garments can be fitted in a life-like way, i.e., jackets are donned "arms first" and dresses, trousers and skirts are stepped into. However, upper garments may more easily be donned over the feet due to the diameter of the doll's head and the usual positioning of the arms. Once clothed, the doll's limbs can still be moved. The garments are easily interchanged, even by younger children. One garment can be donned over another, e.g. a jacket over a dress.

Whilst particular embodiments have been described, the invention is not limited thereto. For example, dolls according to the invention can comprise male figures or figurines and non-human figures as well as female dolls.

The garments can include suits, shirts, coats, shorts, cloaks, capes, uniforms, hats, shoes, helmets, armour and scarfs. In addition, the term "garment" as used in this specification should be understood to include any flexible article which can be fitted to the external surface of a doll, including second skins, outfits resembling other animals or creatures and molded surfaces resembling rock, flames, bones or the like.

Whilst the invention is particularly apt for miniature dolls, it is applicable to dolls of any shape and size.

What is claimed is:

1. A play set comprising, in cooperative combination, a doll donned and fitted with a seamless garment which removably encloses around a part of the doll and is adapted to be removed, dressed and refitted again to the doll in a life-like manner, the doll being articulated at the joints of the shoulders, elbows, knees and hips, the garment being molded from an elastomeric material selected from the group consisting of ethylene vinyl acetate copolymer, styrene-butadiane-styrene, styrene-isoprene-styrene, styrene-diene, styrene-isoprene-butylene block coploymers containing mineral oil, branched styrene copolymer, styrene butadiene rubber, styrene-butadiene triblock rubber, styrene-isoprene-styrene linear block polymer, styrene-butadiene radial block copolymer, butadiene-styrene copolymer rubber, the garment having a wall thickness from 1 to 3 mm, the garment material having an average modulus of elasticity of less than 1 $MN/m^2$, and the garment comprising at least one integrally molded detail consisting of one of the following, a belt, a button and a collar for the garment.

2. The set of claim 1, wherein the material has a 100% modulus of elasticity between 120 and 350 $KN/m^2$.

3. The set of claim 2, wherein the material of the garment has a 100% modulus of elasticity between 240 and 280 $KN/m^2$.

4. The set of claim 1, wherein the material of the garment has a 300% modulus of elasticity between 440 and 490 $KN/m^2$.

5. The set of claim 1, wherein the doll has a height of less than 8 cm and the garment is adapted in size to be fitted to and removed from the doll.

6. The set of claim 1, which comprises a plurality of seamless garments each being adapted to be removed and refitted to the doll.

7. The set of claim 1, wherein the garment is a dress, a pair of dungarees, a jacket, a skirt, a vest, a pair of slacks, a hat or a coat.

8. The set of claim 1, wherein the material of the garment has a decorative coating of paint or varnish.

9. A doll's seamless garment which is adapted to be dressed, fitted and be removed in a life-like manner for use with a doll which is articulated at the joints of the shoulders, elbows, knees and hips, which garment is molded from a copolymer material selected from the group consisting of one of the following: ethylene vinyl acetate copolymer, styrene-butadiene-styrene, styrene-isoprene-styrene, styrene-diene, styrene-isoprene-butylene block copolymers containing mineral oil, branched styrene copolymer, styrene butadiene, styrene-butadiene triblock, styrene-isoprene-styrene linear block polymer, styrene-butadiene radial block copolymer, butadiene-styrene copolymer, the garment having a height of less than 8 cm and a wall thickness from 1 to 3 mm, the material having an average modulus of elasticity of less than 1 $MN/m^2$ and the garment comprising at least one integrally molded detail selected from the group consisting of the following: a belt, a button and a collar for the garment.

10. The doll's garment of claim 9 wherein the material has a 100% modulus of elasticity between 120 and 350 $KN/m^2$.

11. The doll's garment of claim 10 wherein the material of the garment has a 100% modulus of elasticity between 240 and 280 $KN/m^2$.

* * * * *